US007287835B2

(12) United States Patent
Kaneko et al.

(10) Patent No.: US 7,287,835 B2
(45) Date of Patent: Oct. 30, 2007

(54) LIQUID EJECTION HEAD AND IMAGE RECORDING APPARATUS

(75) Inventors: Yasuhisa Kaneko, Kanagawa (JP); Seiichi Inoue, Kanagawa (JP); Takaaki Kosuge, Kanagawa (JP); Koji Furukawa, Shizuoka (JP); Yusuke Nakazawa, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/443,350

(22) Filed: May 31, 2006

(65) Prior Publication Data

US 2006/0268066 A1 Nov. 30, 2006

(30) Foreign Application Priority Data

May 31, 2005 (JP) ..... 2005-159329

(51) Int. Cl.
*B41J 2/06* (2006.01)

(52) U.S. Cl. ..... 347/55

(58) Field of Classification Search ..... 347/55, 347/9, 54, 101, 77
See application file for complete search history.

(56) References Cited

U.S. PATENT DOCUMENTS 6,158,844 A 12/2000 Murakami et al.
6,908,177 B2 * 6/2005 Suganuma ..... 347/55
2004/0183879 A1 * 9/2004 Nakazawa ..... 347/101
2005/0046675 A1 * 3/2005 Aoshima ..... 347/55

FOREIGN PATENT DOCUMENTS

JP 10-230608 A 9/1998

* cited by examiner

*Primary Examiner*—K. Feggins
(74) *Attorney, Agent, or Firm*—Sughrue Mion, PLLC

(57) ABSTRACT

A liquid ejection head ejects droplets of solution in which charged particles are dispersed by exerting electrostatic force on the solution. The head includes an insulating ejection substrate including through holes, ejection electrodes arranged to respectively correspond to the through holes, and solution guides that respectively pass through the through holes and protrude from the ejection substrate. Each solution guide includes a support portion of flat-plate shape and a tip end portion of flat-plate shape that is extendingly provided to form a step in a thickness direction in an end portion of the support portion and is thinner than the support portion. An image recording apparatus includes the liquid ejection head and an image corresponding to image data is recorded on a recording medium.

14 Claims, 6 Drawing Sheets

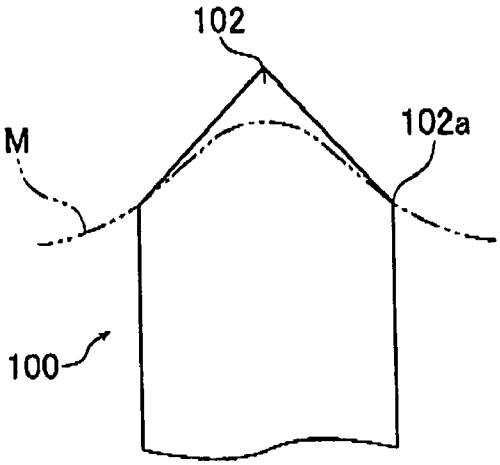
FIG.6A
PRIOR ART
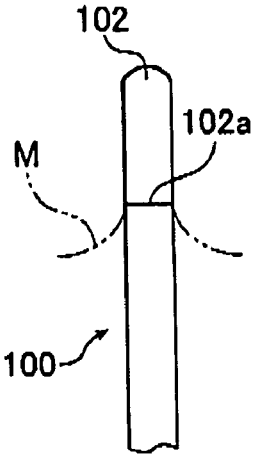
FIG.6B
PRIOR ART
FIG.7
PRIOR ART
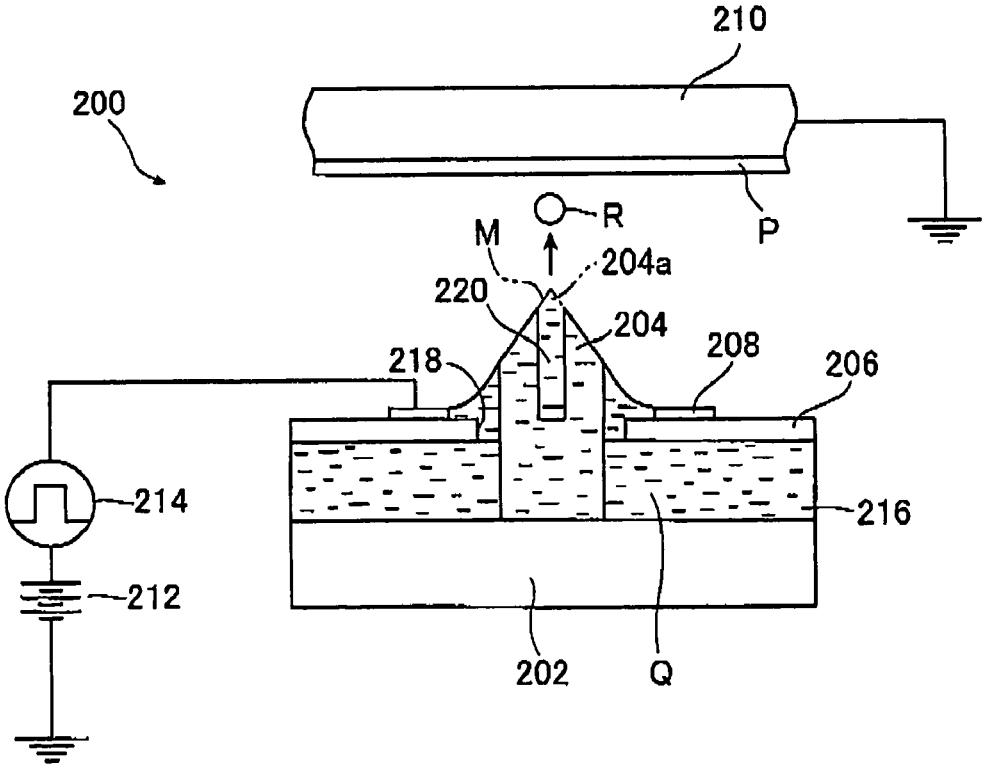

LIQUID EJECTION HEAD AND IMAGE RECORDING APPARATUS

BACKGROUND OF THE INVENTION

The present invention relates to a liquid ejection head for ejecting droplets by exerting electrostatic forces on a solution in which charged particles are dispersed, and an image recording apparatus including the liquid ejection head. In particular, the present invention relates to a liquid ejection head capable of maintaining a meniscus at a high position, and an image recording apparatus including the liquid ejection head.

Known examples of liquid ejection heads for ink jet that perform image recording (drawing) by ejecting ink droplets include an ejection head for so-called thermal ink jet that ejects ink droplets by means of expansive forces of air bubbles generated in ink through heating of the ink, and an ejection head for so-called piezoelectric-type ink jet that ejects ink droplets by giving pressures to ink using piezoelectric elements.

In the case of the thermal ink jet, however, the ink is partially heated to 300° C. or higher, so there arises a problem in that a material of the ink is limited. On the other hand, in the case of the piezoelectric-type ink jet, there occurs a problem in that a complicated structure is used and an increase in cost is inevitable.

Known as ink jet that solves the problems described above is electrostatic ink jet which uses ink containing charged colorant particles (fine particles), exerts electrostatic forces on the ink, and ejects ink droplets by means of the electrostatic forces (for example, JP 10-230608 A).

An ejection head for the electrostatic ink jet includes an insulating ejection substrate in which many through holes (ejection ports) for ejecting ink droplets are formed, and ejection electrodes that respectively correspond to the ejection ports, and ejects ink droplets by exerting electrostatic forces on ink through application of predetermined voltages to the ejection electrodes. More specifically, with the construction, the ejection head ejects the ink droplets by controlling on/off of the voltage application to the ejection electrodes (driving the ejection electrodes by modulation) in accordance with image data, thereby recording an image corresponding to the image data onto a recording medium.

An example of such a liquid ejection head for the electrostatic ink jet is disclosed in JP 10-230608 A as an ejection head 200. As conceptually shown in FIG. 7, the ejection head 200 includes a support substrate 202, an ink guide 204, an ejection substrate 206, an ejection electrode 208, a bias voltage source 212, and a drive voltage source 214.

In the ejection head 200, the support substrate 202 and the ejection substrate 206 are each an insulating substrate and are arranged to be spaced apart from each other by a predetermined distance.

Many through holes (substrate through holes) that each serve as an ejection port 218 for ink droplets are formed in the ejection substrate 206, and a gap between the support substrate 202 and the ejection substrate 206 serves as an ink flow path 218 for supplying ink Q to the ejection port 218. In addition, the ring-shaped ejection electrode 208 is provided to the upper surface of the ejection substrate 206 (the surface of the ejection substrate 206 on the side from which ink droplets R are ejected) to surround the ejection port 218. The bias voltage source 212 and the drive voltage source 214 serving as a pulse voltage source are connected to the ejection electrode 208, which is grounded through the voltage sources 212 and 214.

On the other hand, the ink guide 204 is provided to the support substrate 202 so as to correspond to each ejection port 218. The ink guide 204 extendes through the ejection port 218 and protrudes from the ejection substrate 206. Also, an ink guide groove 220 for supplying the ink Q to a tip end portion 204*a* of the ink guide 204 is formed by cutting out the tip end portion 204*a* by a predetermined width.

In an (ink jet) recording apparatus disclosed in JP 10-230608 A using the ejection head 200 described above, at the time of image recording, a recording medium P is supported by a counter electrode 210.

The counter electrode 210 functions not only as a counter electrode for the ejection electrode 208 but also as a platen for supporting the recording medium P at the time of the image recording, and is arranged to face the upper surface of the ejection substrate 206 and to be spaced apart from the tip end portion 204*a* of the ink guide 204 by a predetermined distance.

In the ejection head 200, at the time of the image recording, an ink circulation mechanism (not shown) causes the ink Q containing the charged colorant particles to flow in the ink flow path 216 in a direction, for instance, from the right side to the left side in FIG. 7. Note that the colorant particles of the ink Q are charged to the same polarity as the voltage applied to the ejection electrode 208.

The recording medium P is supported by the counter electrode 210 and faces the ejection substrate 206.

Further, a DC voltage of, for example, 1.5 kV is constantly applied from the bias voltage source 212 to the ejection electrode 208 as a bias voltage.

As a result of the ink Q circulation and the bias voltage application, by the action of surface tension of the ink Q, a capillary phenomenon, an electrostatic force due to the bias voltage, and the like, the ink Q is supplied from the ink guide groove 220 to the tip end portion 204*a* of the ink guide 204, a meniscus M of the ink Q is formed at the ejection port 218, the colorant particles move to the vicinity of the ejection port 218 (migration due to an electrostatic force), and the ink Q is concentrated in the ejection port 218 or the tip end portion 204*a*.

In this state, when the drive voltage source 214 applies a pulse-shaped drive voltage of, for example, 500 V corresponding to image data (drive signal) to the ejection electrode 208, the drive voltage is superimposed on the bias voltage and the supply and concentration of the ink Q to the tip end portion 204*a* are promoted. When a movement force of the ink Q and the colorant particles to the tip end portion 204*a* and an attraction force from the counter electrode 210 exceed the surface tension of the ink Q, a droplet (ink droplet R) of the ink Q in which the colorant particles are concentrated is ejected.

The ejected ink droplet R flies due to momentum at the time of the ejection and the attraction force by the counter electrode 210, adheres to the recording medium P, and forms an image.

As described above, the liquid ejection head for electrostatic ink jet ejects the ink droplets R by controlling a balance between the surface tension of the ink Q and the electrostatic force exerted on the ink Q.

Accordingly, in order to perform the ejection of the ink droplets at a low drive voltage as well as high speed (high recording (ejection) frequency) with stability, the ink guide provided for each ejection port is important and is required to suitably guide the ink and appropriately stabilize the meniscus of the ink at the ejection port (hereinafter referred to as a "meniscus stability"), capability (hereinafter referred to as a "electric field concentrating capability") to favorably concentrate the electrostatic force, and the like.

In order to achieve such characteristics, in the liquid ejection head for electrostatic ink jet, the ink guide is devised in various manners.

For instance, in the liquid ejection head disclosed in JP 10-230608 A, as described above, by notching the tip end portion 204*a* of the ink guide 204 by a predetermined width to form the ink guide groove 220, capability of supplying the ink Q to the tip end portion 204*a* of the ink guide 204 is further improved.

In order to obtain an ink guide for holding a favorable meniscus with stability in the manner described above, it is preferable that the ink guide be molded with favorable moldability and with high precision so that ink can be guided with reliability.

In order to convey colorant particles up to a guide tip end portion, it is required to form a favorable meniscus so that the tip end portion is wetted with the ink solution. A pressure required for the liquid to wet up to the tip end portion having a shape with a pointed tip end is inversely proportional to the radius of curvature of the tip end, as expressed by the formula (1) given below.

$$P=2\cdot\gamma/R \quad (1)$$

In the above formula (1), P is a pressure (Pa) required to hold the meniscus, γ is the surface tension (N/m) of the liquid forming the meniscus, and R is the radius of curvature (m) of the meniscus.

It can be seen, from the above formula (1), that as the radius of curvature or the thickness of the tip end portion of the ink guide is reduced, the pressure to form the meniscus is required to be increased.

However, there is a limitation on the pressure that can be given to increase the height of the meniscus. Therefore, in the case of the ink guide 204 disclosed in JP 10-230608 A, the ink guide groove 220 is formed in the tip end portion 204*a* and the meniscus M is held at a high position by utilizing capillary action by the ink guide groove 220.

In a structure of the ink guide 204 disclosed in JP 10-230608 A, however, the tip end portion 204*a* is notched, so there is a problem in that the sharpness of the tip end portion 204*a* is lowered and the size of the ink droplet that can be ejected is limited.

Also, in the structure of the ink guide 204 disclosed in JP 10-230608 A, the tip end portion 204*a* is notched, so the tip end shape of the ink guide 204 is formed by the ink Q. Therefore, the tip end shape of the ink guide 204 is determined by the surface tension of the ink Q used and the pressure exerted on the ink Q. The tip end shape formed by the ink Q fluctuates due to disturbance such as vibration or supply of the ink Q for replenishment of the ink Q consumed through ejection of the ink droplets R. Therefore, there is a problem in that ink adhering position accuracy is lowered, so that it is almost impossible to form an image with stability and at high resolution.

Further, there is a problem in that it is difficult to reduce the width of the tip end portion of the ink guide from the viewpoint of processing. Still further, the ink guide 204 disclosed in JP 10-230608 A requires to form the ink guide groove 220 therein, so processing becomes particularly difficult when the width of the tip end portion is reduced.

SUMMARY OF THE INVENTION

An object of the present invention is to solve the above-mentioned problems of the conventional techniques and to provide a liquid ejection head which is superior in a meniscus stability, and capable of holding a meniscus at a high position and stably ejecting droplets, and an image recording apparatus including the liquid ejection head.

In order to achieve the above object, a first aspect of the present invention provides a liquid ejection head for ejecting droplets of solution in which charged particles are dispersed by exerting electrostatic force on the solution, including:

an insulating ejection substrate including through holes for ejecting the droplets;

ejection electrodes for exerting the electrostatic force on the solution, which are arranged to respectively correspond to the through holes; and solution guides that respectively pass through the through holes and protrude from the ejection substrate toward a droplet ejection side, wherein each of the solution guides includes a support portion of flat-plate shape and a tip end portion of flat-plate-shape that is extendingly provided to form a step at a predetermined position in a thickness direction in an end portion of the support portion and is thinner than the support portion, and wherein the solution guides are arranged so that the tip end portion is directed toward the droplet ejection side.

In the present invention, preferably, the tip end portion of each of the solution guides has a tip end shape that is gradually narrowed toward the droplet ejection side, and the end portion of the support portion at the step formed through connection of the tip end portion is formed in approximately the same shape as the tip end shape.

Moreover, in the present invention, preferably, the tip end portion of each of the solution guides has a tip end shape that is gradually narrowed toward the droplet ejection side, and the end portion of the support portion at the step formed through connection of the tip end portion is formed in a comb shape to have at least one tooth portion formed by forming at least one notched portion to extend toward the droplet ejection side.

Further, in the present invention, preferably, the at least one tooth portion of the end portion of the support portion formed in the comb shape protrudes toward the droplet ejection side with respect to the end portion of the support portion.

Further, in the present invention, preferably, a radius of curvature of a tip end of the tip end portion of each solution guide is 2 μm or more.

Further, in the present invention, preferably, a difference between a thickness of the support portion of each solution guide and a thickness of the tip end portion thereof is 20 μm or more.

Further, in the present invention, preferably, the tip end portion is extendingly provided for the support portion so that the step is formed only on one surface side of the tip end portion.

A second aspect of the present invention provides an image recording apparatus including the liquid ejection head according to the first aspect of the present invention, wherein an image corresponding to image data is recorded on a recording medium.

According to the liquid ejection head of the present invention, each solution guide includes a flat-plate-shaped support portion and a flat-plate-shaped tip end portion that is extendingly provided to form a step at a predetermined position in a thickness direction in an end portion of the support portion and is thinner than the support portion, and is arranged so that the tip end portion thereof is directed toward a droplet ejection side, so the step of the solution guide functions as a meniscus fixing position. The meniscus fixing position obtained by forming the step is a stable fixed point that will not move once fixed. In addition, the fixed point functions also as a fixing position of a new meniscus and it becomes possible to form the meniscus at a higher position. As a result, it becomes possible to make a solution reach the tip end portion of the solution guide and form a meniscus having a shape similar to the tip end shape of the tip end portion of the solution guide.

By forming the step for the solution guide in the manner described above, it becomes possible to hold the meniscus formed by the solution at a high position of the solution guide without taking the tip end shape of the solution guide and the pressure of the solution into consideration.

Also, with the liquid ejection head according to the present invention, it becomes possible to form a meniscus based on the tip end shape of the tip end portion of the solution guide, so a stabilized meniscus shape is obtained which will not fluctuate even due to disturbance such as vibration.

Further, the image recording apparatus according to the present invention includes a liquid ejection head including solution guides, each of which includes a flat-plate-shaped support portion and a flat-plate-shaped tip end portion that is extendingly provided to form a step at a predetermined position in a thickness direction in an end portion of the support portion and is thinner than the support portion, and are arranged so that the tip end portion is directed toward the droplet ejection side. Thus, the step of the solution guide functions as a meniscus fixing position. The meniscus fixing position obtained by forming the step is a stable fixed point that will not move once fixed. In addition, the fixed point functions also as a fixing position of a new meniscus and it becomes possible to form the meniscus at a higher position and set the meniscus at a high position in proximity to the tip end portion of the solution guide. As a result, it becomes possible to make the solution reach the tip end portion of the solution guide and form a meniscus having a shape similar to the tip end shape of the tip end portion of the solution guide. As described above, it becomes possible to form a meniscus based on the tip end shape of the tip end portion of the solution guide, so a stabilized meniscus shape is obtained which will not fluctuate even due to disturbance such as vibration. With the image recording apparatus according to the present invention, supply of the solution to the solution guide is performed smoothly, so ejection frequency responsivity is improved and it becomes possible to eject droplets with stability even at a high ejection frequency. As a result, it becomes possible to record high-resolution images with stability at high speed.

BRIEF DESCRIPTION OF THE DRAWINGS

In the accompanying drawings:

FIG. 6A is a schematic plan view showing a conventional ink guide;

FIG. 6B is a schematic side view of FIG. 6A; and

FIG. 7 is a conceptual diagram for explanation of an example of a conventional liquid ejection head.

DETAILED DESCRIPTION OF THE PREFERRED EMBODIMENTS

Hereinafter, a liquid ejection head and an image recording apparatus according to the present invention will be described in detail based on preferred embodiments illustrated in the accompanying drawings.

Figure 1:
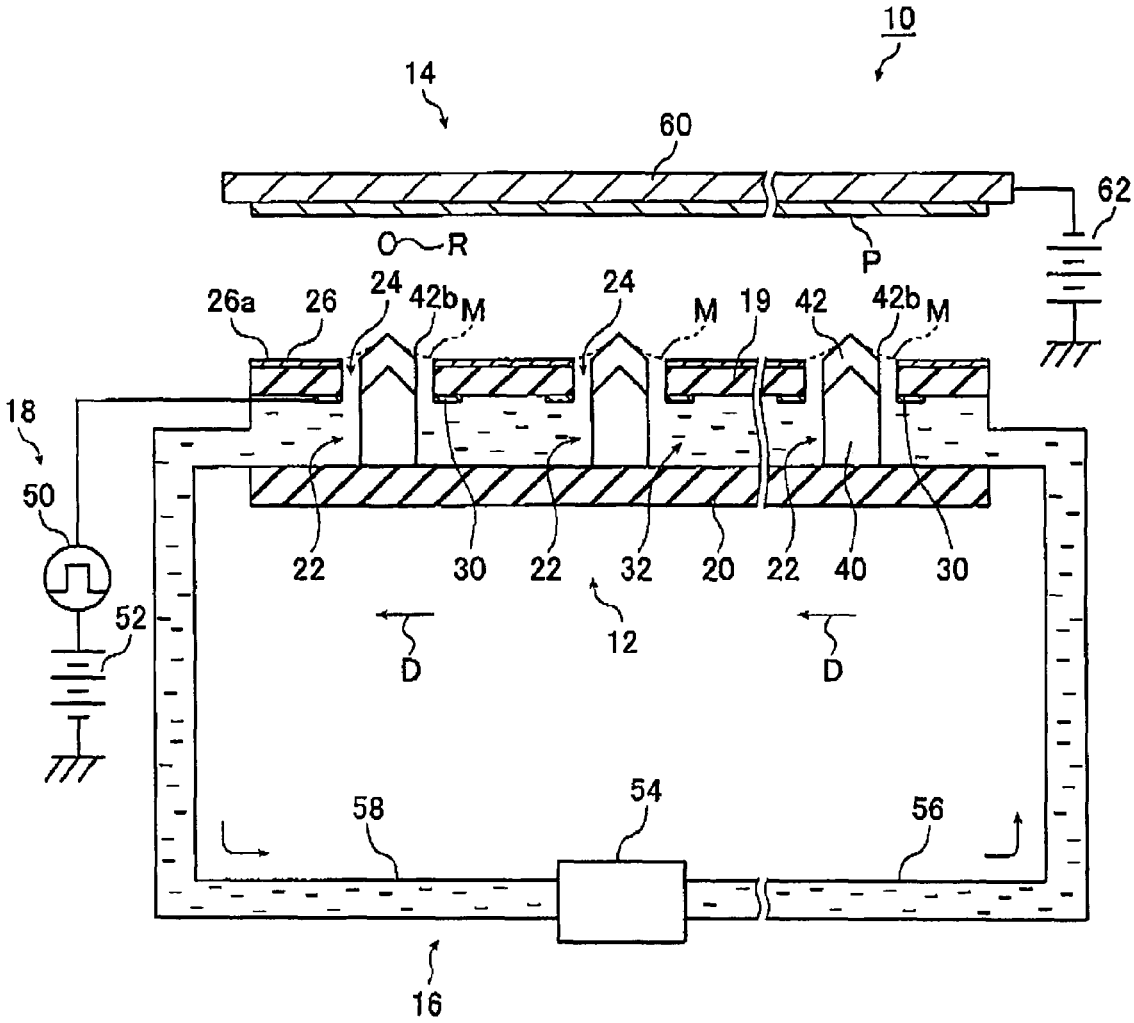
FIG. 1 is a schematic cross-sectional view showing an image recording apparatus including a liquid ejection head according to a first embodiment of the present invention.
Figure 2:
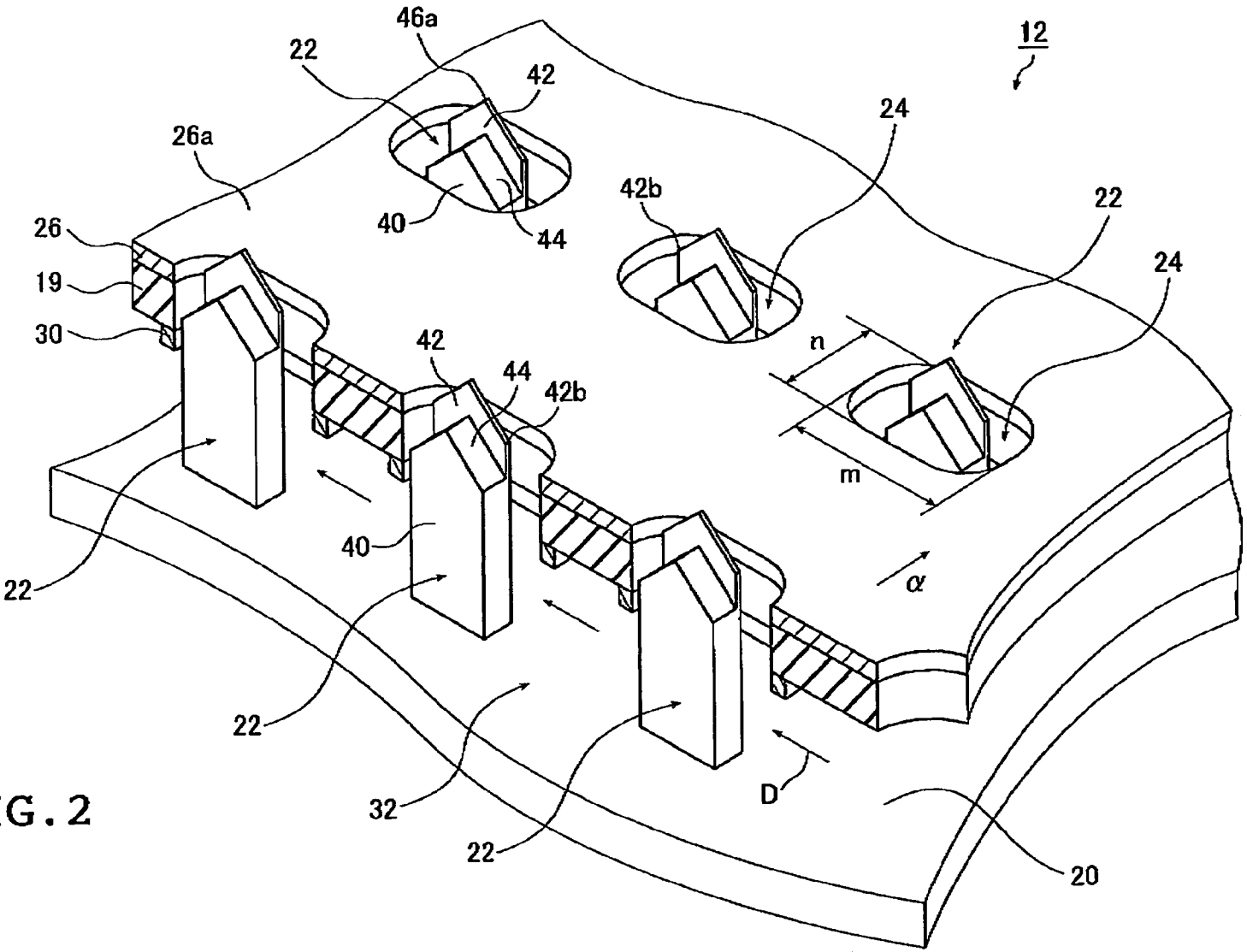
FIG. 2 is a schematic perspective view showing a main portion of the liquid ejection head shown in FIG. 1.

FIG. 1 is a schematic cross-sectional view showing an image recording apparatus including a liquid ejection head according to a first embodiment of the present invention, and FIG. 2 is a schematic perspective view showing a main portion of the liquid ejection head shown in FIG. 1.

Figure 3A:
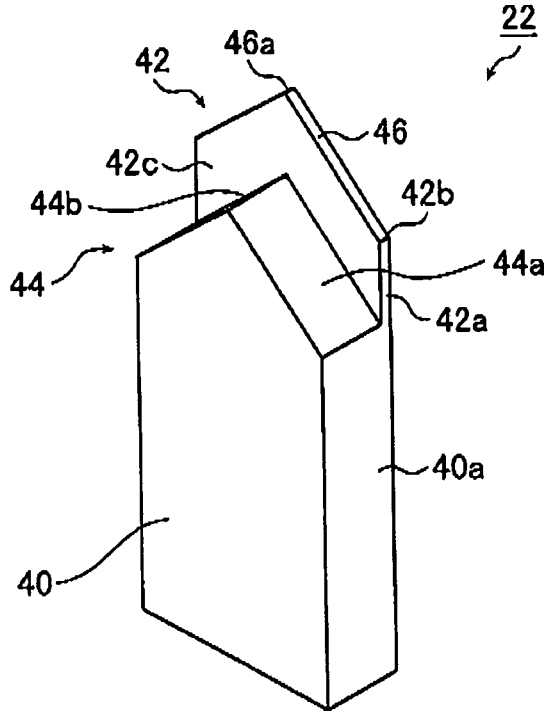
FIG. 3A is a schematic perspective view showing an ink guide of the liquid ejection head according to the first embodiment of the present invention.
Figure 3B:
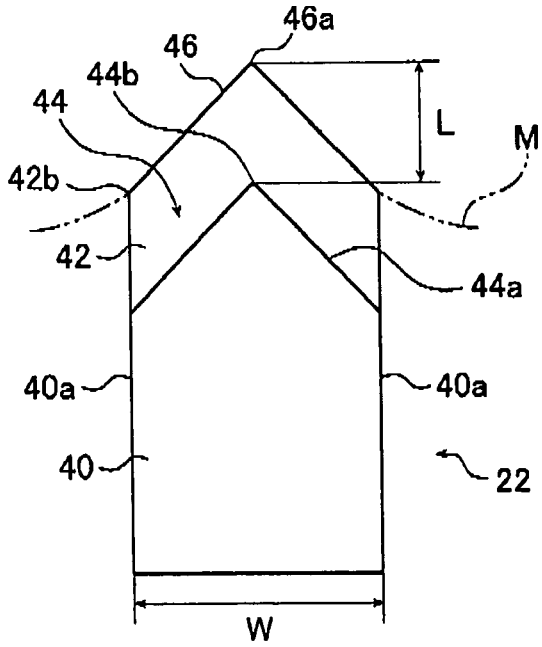
FIG. 3B is a schematic front view of FIG. 3A.
Figure 3C:
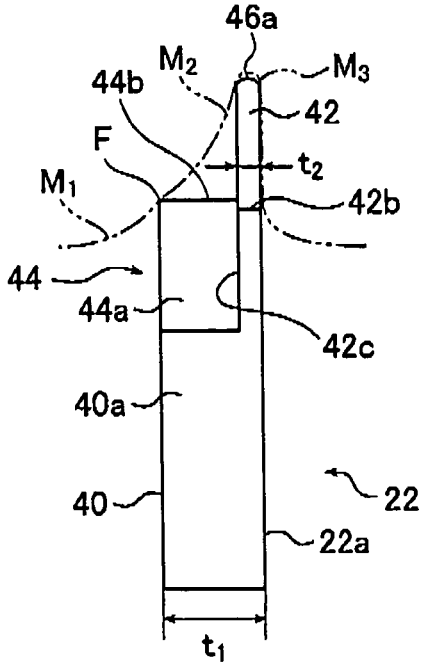
FIG. 3C is a schematic side view of FIG. 3A.

FIG. 3A is a schematic perspective view showing an ink guide of the liquid ejection head according to the first embodiment of the present invention, FIG. 3B is a schematic front view of FIG. 3A, and FIG. 3C is a schematic side view of FIG. 3A.

An image recording apparatus 10 shown in FIG. 1 is an electrostatic ink jet recording apparatus which performs image recording (drawing) on a recording medium P by ejecting ink droplets R by means of electrostatic force. The image recording apparatus 10 basically includes a liquid ejection head 12, holding means 14 for holding the recording medium P, an ink circulation system 16, and voltage application means 18.

As shown in FIGS. 1 and 2, the liquid ejection head 12 of the image recording apparatus 10 is, for instance, a so-called line head including lines (hereinafter referred to as the "nozzle lines") of ejection ports 24 for ejecting the ink droplets R whose length corresponds to the length of one side of the rectangular recording medium P.

In the image recording apparatus 10 of this embodiment, the recording medium P is held by the holding means 14, and the holding means 14 is moved (conveyed for scanning) in a direction orthogonal to the nozzle lines of the liquid ejection head 12 in a state where the recording medium P is located in a predetermined recording position and faces the liquid ejection head 12, thereby allowing two-dimensional scanning of the entire surface of the recording medium P with the nozzle lines. In synchronization with the scanning, the ink droplets R are ejected from each ejection port 24 of the liquid ejection head 12 by modulation in accordance with an image to be recorded, thereby allowing recording of the image on the recording medium P in an on-demand manner.

Also, at the time of the image recording, the ink Q is circulated by the ink circulation system 16 through a predetermined circulation path including the liquid ejection head 12 (ink flow path 32 to be described later) and is supplied to each ejection port 24.

The liquid ejection head 12 is a liquid ejection head for electrostatic ink jet that ejects the ink Q as the ink droplets R by means of electrostatic forces.

The liquid ejection head 12 basically includes an ejection substrate 19, a support substrate 20, and ink guides (liquid solution guides) 22 as shown in FIGS. 1 and 2, and the lower surface of ejection substrate 19 and the upper surface of support substrate 20 are located so as to be opposed to each other.

The ejection substrate 19 is a substrate made of a ceramics material, such as $Al_2O_3$ or $ZrO_2$, an insulating material such as polyimide, and many ejection ports 24 for ejecting the ink droplets R of the ink Q are established so that they pass through the ejection substrate 19.

As shown in FIG. 2, as a preferable example in which higher-resolution and higher-speed image recording is possible, the liquid ejection head 12 includes the ejection ports 24 arranged in a two-dimensional lattice manner.

It should be noted here that the liquid ejection head according to the present invention is not limited to the construction in FIG. 2, in which the ejection ports 24 are arranged in a lattice manner, and may have a construction in which adjacent nozzle lines are displaced from each other by a half pitch in the nozzle line direction so that the ejection ports are arranged in a staggered lattice manner, for instance. Alternatively, the liquid ejection head according to the present invention may have a construction in which the ejection ports are not arranged in a two-dimensional manner but only one nozzle line is included.

Also, the present invention is not limited to the line head in FIG. 1 and FIG. 2 and may be applied to a so-called shuttle-type liquid ejection head that performs drawing by conveying the recording medium P intermittently by a predetermined length corresponding to the length of the nozzle line and moving the liquid ejection head in a direction orthogonal to the nozzle line in synchronization with the intermittent conveying.

Further, the liquid ejection head according to the present invention may be a liquid ejection head that ejects only one kind of ink corresponding to monochrome image recording or a liquid ejection head that ejects multiple kinds of ink corresponding to color image recording.

The upper surface region (the side from which droplets are ejected=the surface on the recording-medium P side, which will be hereinafter referred to as an "upside", and the opposite side thereof will be referred to as a "downside") of the ejection substrate 19 other than the ejection ports 24 is covered with a shield electrode 26 entirely.

The shield electrode 26 is a sheet-shaped electrode made of a conductive metallic plate or the like and common to every ejection port 24. The shield electrode 26 is held at a predetermined potential (including 0 V when grounded). With the shield electrode 26, it becomes possible to suppress electric field interference between the ejection portions by shielding against electric lines of force between of the ejection ports 24 (ejection portions) adjacent to each other, so that the ink droplets R can be stably ejected. Also, as necessary, a surface of each shield electrode 26 may be subjected to ink repellent treatment.

For the lower surface of the ejection substrate 19, ejection electrodes 30 are provided to respectively correspond to the ejection ports 24. The ejection electrodes 30 are, for example, a ring-shaped electrode surrounding ejection port 24, and are connected to the voltage application means 18.

The voltage application means 18 is connected to ejection electrodes 30. The voltage application means 18 is a unit in which a drive voltage source 50 and a bias voltage source 52 are connected to each other in series, with a pole (positive pole, for instance) having the same polarity as that of the potential of the charged colorant particles of the ink Q being connected to the ejection electrodes 30 and the other pole being grounded.

The drive voltage source 50 is, for instance, a pulse voltage source and supplies pulse-shaped drive voltages modulated in accordance with an image to be recorded (image data=ejection signal) to the ejection electrodes 30. The bias voltage source 52 constantly applies a predetermined bias voltage to the ejection electrodes 30 during image recording. With the bias voltage source 52 (that is, through the bias voltage application by the bias voltage source 52), it becomes possible to achieve a reduction in drive voltage, which makes it possible to achieve a reduction in voltage consumption and a cost reduction of the drive voltage source.

It should be noted that the ejection electrodes 30 are not limited to the ring-shaped electrodes surrounding the ejection ports 24 and may be rectangle-shaped electrodes surrounding the ejection ports 24. In addition, the ejection electrodes 30 are not limited to the electrodes surrounding the entire regions of the ejection ports 24 and ejection electrodes having an approximately C-letter shape or the like are also usable.

In this case, particularly in the case of using the ejection electrode having the approximately C-letter shape or the like as the ejection electrode 30, it is preferable that the ejection electrode 30 have such a shape in which a part thereof on the upstream side in an ink flow direction D is removed. With this construction, no electric field that inhibits inflow of colorant particles into the ejection ports from the upstream side in the ink flow direction D is formed, so it becomes possible to supply the colorant particles to the ejection ports 24 with efficiency, Also, the ejection electrode 30, particularly the ejection electrode having the approximately C-letter shape is arranged such that no part thereof exists on the upstream side, and a part thereof exists on the ink downstream side, so that electric fields are formed in such a direction that colorant particles having inflowed into the ejection ports 24 are retained at the ejection ports 24. As a result, by forming the ejection electrodes 30, particularly the ejection electrodes having the approximately C-letter shape to have such the shape in which a part thereof on the upstream side in the ink flow direction D with respect to the ejection ports 24 is removed, it becomes possible to further enhance the capability of supplying particles to the ejection ports 24.

The support substrate 20 is a substrate formed using an insulating material such as glass.

The ejection substrate 19 and the support substrate 20 are arranged so that they are spaced apart from each other by a predetermined distance and a gap therebetween is set as an ink flow path 32 for supplying the ink Q to each ejection port 24.

The ink flow path 32 is connected to an ink circulation system 16 to be described later and as a result of circulation of the ink Q through a predetermined path by the ink circulation system 16, the ink Q flows through the ink flow path 32 in the ink flow direction D (in the example illustrated in FIG. 1, from the right to the left, for instance) and is supplied to each ejection port 24.

The ink guides 22 are provided on the upper surface of the support substrate 20.

The ink guides 22 are each a member for facilitating the ejection of the ink droplets R by guiding the ink Q supplied from the ink flow path 32 to a corresponding ejection port 24, stabilizing a meniscus through adjustment of the shape and size of the meniscus, and concentrating an electric field (electrostatic force) on the meniscus through concentration of the electric field on itself. The ink guides 22 are respectively arranged for the ejection ports 24 so that they extend through the ejection ports 24 and protrude from the surface of the ejection substrate 19 toward the recording medium P (holding means 14) side.

By each set of one ejection port 24, one ejection electrode 30, and one ink guide 22 corresponding to one another, one ejection portion corresponding to one dot droplet ejection is formed.

As described above, the ink guides 22 are required to be able to suitably guide the ink Q and appropriately stabilize the meniscuses of the ink Q at the ejection ports 24 (that is, superior in the meniscus stability), and also to be able to suitably concentrate the electrostatic forces (that is, favorable electric field concentrating capability). In order to achieve the abilities, it is important that the ink guides 22 are molded with high precision in a shape in which reliable and favorable guiding of the ink is possible even when the ink guides 22 are minute.

Under present circumstances, as disclosed in JP 10-230608 A, the meniscus M (see FIG. 7) is maintained by forming the ink guide groove 220 (see FIG. 7) having a predetermined width in the ink guide 204 (see FIG. 7). As described above, however, the conventional ink guide 204 disclosed in JP 10-230608 A that includes the ink guide groove 220 has a problem in that the sharpness of the tip end portion of the ink guide 204 is lowered and the size of the ink droplets ejected is limited.

Also, the tip end of the tip end portion of the ink guide 204 is formed by the meniscus M, so the tip end shape easily fluctuates due to disturbance such as vibration or ink supply for replenishment of the ink consumed by ejection of the ink droplets R, which leads to a problem in that ink adhering position accuracy is lowered. Further, the ink guide 204 in JP 10-230608 A is a member obtained by forming the ink guide groove 220 and when the width of the ink guide 204 is reduced, processing of the ink guide groove 220 becomes difficult. Thus, it is difficult to reduce the width of the ink guide 204.

The ink guide 22 in this embodiment is a characteristic site of the present invention and includes a flat-plate-shaped support portion 40 and a flat-plate-shaped tip end portion 42 that extends from the support portion 40 while sharing a back surface 22*a* of the ink guide 22 with the support portion 40 as shown in FIGS. 2 and 3A, for instance. The thickness of the tip end portion 42 is set to be thinner than the support portion 40, so a step is formed in a joint portion between the support portion 40 and the tip end portion 42. Also, the ink guide 22 is arranged on the upper surface of the support substrate 20 so that the tip end portion 42 is directed toward a droplet ejection (recording medium P) side.

As shown in FIGS. 3A and 3B, the tip end portion 42 of the ink guide 22 has such a tip end shape that a pair of inclined surfaces 46 respectively connected to side surfaces 42*a* on both sides in a widthwise direction of the tip end portion 42 at shoulder portions 42*b* gradually get closer to each other to be connected at a tip end 46*a*.

For instance, the tip end shape of the tip end portion 42 is an approximately right-angled triangle in the plan view, in which the tip end 46*a* is approximately the right-angled vertex.

It should be noted that as shown in FIGS. 3B and 3C, the tip end 46*a* of the tip end portion 42 of the ink guide 22 has a predetermined curvature in either of the plan view and the side view.

It is preferable that a radius of curvature of the tip end 46*a* be small for sharpening in either of the plan view and the side view. However, when the radius of curvature of the tip end 46*a* is too small, a redundant pressure becomes necessary to raise the position of the meniscus, so there is a lower limit on the radius of curvature of the tip end 46*a*. Therefore, in either of the plan view and the side view, the lower limit of the radius of curvature of the tip end 46*a* is preferably 2 μm or more, more preferably 6 μm or more.

Also, in the plan view, the upper limit of the radius of curvature of the tip end 46*a* is a half of the width of the tip end portion 42. In this case, the tip end portion 42 is formed in a semicircular shape in the plan view. On the other hand, in the side view, the upper limit of the radius of curvature of the tip end 46*a* is a half of the width of the inclined surface 46. In this case, the tip end portion 42 is also formed in a semicircular shape in the side view.

An end portion 44 of the support portion 40 is formed in approximately the same shape as the tip end portion 42, as shown in FIG. 3B. In the end portion 44, a pair of inclined surfaces 44*a* extend from respective side surfaces 40*a* on both sides in the widthwise direction of the support portion 40 at an inclination angle that is the same as that of the inclined surfaces 46 of the tip end portion 42, and are connected to each other at an edge portion 44*b*. Also, as shown in FIG. 3C, the edge portion 44*b* is formed vertically with respect to a surface 42*c* of the tip end portion 42.

Next, the meniscus formed by the ink guide 22 in this embodiment will be described.

In the case of the ink guide 22 in this embodiment, as shown in FIG. 3C, the edge portion 44*b* of the end portion 44 functions as a pinning point F (fixing position) of a meniscus $M_1$ from an ink liquid surface. The pinning point F is determined based on the shape of the end portion 44 and is a stable point that will not move once fixed. In addition, the pinning point F also functions as a pinning point that fixes a new meniscus $M_2$. Consequently, the meniscus $M_2$ is formed at a higher position. As a result, it becomes possible to make the ink Q reach the tip end 46*a* of the tip end portion 42. In addition, a meniscus $M_3$ in approximately the same shape as the tip end 46*a* of the tip end portion 42 is also formed.

On the other hand, in the case of a conventional flat-plate-shaped ink guide 100 shown in FIGS. 6A and 6B obtained by forming a tip end portion 102 in a triangle shape, by giving hydrostatic pressure to ink, an ink liquid surface is raised and a meniscus M is formed. In this case, however, no pinning point exists, so the meniscus M is obtained only with the ink hydrostatic pressure at the ejection port 24. Even in the case of the conventional ink guide 100, by increasing the ink hydrostatic pressure, it is possible to raise the position of the meniscus M to reach a tip end portion 102. When doing so, however, it is required to excessively increase the ink hydrostatic pressure, so the sharpness of the meniscus shape is lowered and ejection of minute ink droplets becomes difficult. Consequently, it becomes almost impossible to reduce the sizes of dots obtained. Also, when the ink pressure is increased too much, there arises a danger that the meniscus may collapse.

Also, it is preferable that the ink guide 22 in this embodiment be arranged so that the shoulder portions 42*b* of the tip end portion 42 protrude from the surface of the ejection port 24 (surface 26*a* of the guard electrode 26). With this construction, the effect that the position of the meniscus is raised by the end portion 44 (step) of the ink guide 22 is easily developed, which makes it possible to maintain the position of the meniscus M at a higher position.

Also, it is preferable that the edge portion 44*b* of the end portion 44 protrude in the upward direction with respect to the shoulder portions 42*c*. With this construction, it becomes possible to set the postion of the meniscus M at a higher position. However, even when the edge portion 44*b* of the end portion 44 exists lower than the shoulder portions 42*c*, it is possible to provide the effect that the position of the meniscus M is set at a high position.

It should be noted that it is possible to form the ink guide 22 using, for instance, an organic resin, glass, silicon, or ceramics. Also, a metal may be evaporated onto the tip end portion 42 of the ink guide 22. By forming a metal evaporated film on the tip end portion 42 of the ink guide 22 in this manner, the dielectric constant of the tip end portion 42 of the ink guide 22 is substantially increased. As a result, it becomes easier to generate a strong electric field and improve the ink ejection property.

Also, it is possible to produce the ink guide 22 using various manufacturing methods used in a semiconductor manufacturing process, such as a photolithography method, or a laser processing method.

Also, the ink guide 22 in this embodiment has such a construction that the tip end portion 42 is provided to extend from the support portion 40 while sharing the back surface 22*a* of the ink guide 22 with the support portion 40, and a step is formed only for a surface on a front surface 42*c* side of the tip end portion 42. However, the present invention is not limited to this and it is sufficient that the tip end portion 42 extends from the support portion 40 to form a step. When consideration is given to the symmetric property of the meniscus, a construction is more preferable in which a step is formed for each of the front surface and the back surface of the tip end portion 42. In this case, however, the size of the meniscus formed at the tip end is increased and it is required to reduce the thickness of the tip end portion in order to reduce the size of the meniscus. Therefore, from the viewpoint of workability, a structure is more preferable in which a step is formed only for one surface of the tip end portion 42.

Also, the overall height of the ink guide 22 in this embodiment is 580 μm, the overall width W of the ink guide 22 (width of the support portion 40) is 210 μm, and the tip end angle of the tip end portion 42 formed by a pair of inclined surfaces 46 is 90°, for instance. Further, the thickness $t_1$ of the support portion 40 is 50 μm and the thickness $t_2$ of the tip end portion 42 is 13 μm. Still further, a tip end portion length L that is a distance between the edge portion 44*b* of the end portion 44 and the tip end 46*a* of the tip end portion 42 is 100 μm.

Still further, in this embodiment, it is preferable that a difference (step) between the thickness $t_1$ of the support portion 40 of the ink guide 22 and the thickness $t_2$ of the tip end portion 42 of the ink guide 22 is 20 μm or more. When the ink guide 22 in this embodiment does not have the difference (step) of 20 μm or more, the meniscus pinning effect is reduced.

Also, when consideration is given to electric field concentration in the tip end portion of the ink guide, that is, the tip end portion of the meniscus, it is preferable that the ink guide 22 in this embodiment be formed so that at least its upper portion is gradually narrowed toward the tip end. By sharpening the tip end portion of the ink guide in this manner, the size of the meniscus is reduced, so it becomes possible to improve the ink droplet ejection property and reduce the size of the ink droplets R.

As shown in FIG. 2, each ejection port 24 has a cocoon shape that is elongated in the ink flow direction and is obtained by forming both short sides of a rectangle in a semicircle shape. The aspect ratio (m/n) between a length m in the ink flow direction D and a length n in a direction α orthogonal to the ink flow direction D of the ejection port 24 is 1 or more, for instance. Also, the ink guide 22 is arranged so that its widthwise direction coincides with the ink flow direction D of the ejection port 24.

In this embodiment, by setting the aspect ratio of the ejection port 24 at 1 or more, supply of the ink Q to the ejection port 24 is facilitated. That is, it becomes possible to enhance capability of supplying particles of the ink Q to the ejection port 24. As a result, the ink Q is supplied to the ejection port 24 sufficiently and smoothly, so ejection frequency responsivity of the ink droplets R is improved and occurrence of clogging of the ink Q is prevented.

In this embodiment, the ejection port 24 has an elongated cocoon shape but the present invention is not limited to this and it is sufficient that it is possible to eject the ink droplets R from the ejection port 24. Therefore, it is possible to form the ejection port 24 in another arbitrary shape such as an approximately circle shape, an oval shape, a rectangular shape, a rhomboid shape, or a parallelogram shape. Also, for instance, the ejection port 24 may be formed in a rectangular shape, whose long sides extends in the ink flow direction D, or an oval shape or a rhomboid shape whose major axis extends in the ink flow direction. Further, the ejection port 24 may be formed in a trapezoidal shape with its upper base being on the upstream side in the ink flow direction, its lower base being on the downstream side in the ink flow direction, and its height in the ink flow direction being set longer than the lower base. In this case, it does not matter which one of the side on the upstream side and the side on the downstream side is set long. Still further, the ejection port 24 may be formed in a shape in which to each short side of a rectangle whose long sides extend in the ink flow direction, a circle, whose diameter is longer than the short side of the rectangle, is connected. Also, it does not matter whether the ejection port 24 has a shape, whose upstream side and downstream side are symmetric about a center thereof, or a shape whose upstream side and downstream side are asymmetric about a center thereof. For instance, the ejection port may be formed by setting at least one of an upstream-side end portion and a downstream-side end portion of a rectangular ejection port in a semicircle shape.

As described above, the ink is supplied by the ink circulation system 16 to the ink flow path 32 formed between the ejection substrate 19 and the support substrate 20.

The ink circulation system 16 includes ink supply means 54 having an ink tank for reserving the ink Q and a pump for supplying the ink Q, an ink supply flow path 56 that connects the ink supply means 54 and an ink inflow opening of the ink flow path 32 (right-side end portion of the ink flow path 32 in FIG. 1) to each other, and an ink recovery flow path 58 that connects an ink outflow opening of the ink flow path 32 (left-side end portion of the ink flow path 32 in FIG. 1) and the ink supply means 54 to each other. Also, in addition to these construction elements, the ink circulation system 16 may include ink replenishment means for replenishing the ink tank with the ink.

The ink Q is circulated through a path through which the ink Q is supplied from the ink supply means 54 to the ink flow path 32 of the liquid ejection head 12 through the ink supply flow path 56, flows through the ink flow path 32 in the ink flow direction D (flows from the right to the left in FIG. 1), and returns from the ink flow path 32 to the ink supply means 54 through the ink recovery flow path 58. During the ink circulation, the ink is supplied from the ink flow path 32 to each ejection port 24.

It should be noted that as the ink Q that the liquid ejection head 12 according to the present invention ejects, it is possible to use various kinds of ink Q (solution) obtained by dispersing charged fine particles in a dispersion medium (e.g., ink Q obtained by dispersing charged particles containing colorants in a dispersion medium) and is applied to an electrostatic ink jet system. The details of the ink Q will be described later.

As described above, the holding means 14 holds the recording medium P and conveys the recording medium P in a direction (hereinafter referred to as the "scanning direction") orthogonal to the nozzle line direction of the liquid ejection head 12 for scanning.

The holding means 14 includes a counter electrode 60 that also functions as a platen that holds the recording medium P in a state where the medium P faces the upper surface of the liquid ejection head 12 (ejection substrate 19), a counter bias voltage source 62, and scanning and conveying means (not shown) for conveying the recording medium P in the scanning direction for scanning by moving the counter electrode 60 in the scanning direction. By conveying and scanning the recording medium P, the recording medium P is two-dimensionally scanned in its entirety by the ejection ports 24 (nozzle lines) of the liquid ejection head 12 and an image is thus recorded by the ink droplets R ejected from the respective ejection ports 24.

No specific limitation is imposed on the recording medium P holding means achieved by the counter electrode 60 and it is sufficient that a known method, such as a method utilizing static electricity, a method using a jig, or a method by suction, is used.

Also, no specific limitation is imposed on a method of moving the counter electrode 60 and it is sufficient that a known plate-shaped member moving method is used. Note that in the recording apparatus using the liquid ejection head 12 according to the present invention, the recording medium P may be scanned by the nozzle lines by fixing the recording medium P and moving the liquid ejection head 12 for scanning.

The counter bias voltage source 62 applies a bias voltage having a polarity opposite to that of the ejection electrodes 30 (=colorant particles) to the counter electrode 60. Note that the other pole side of the counter bias voltage source 62 is grounded.

Hereinafter, an image recording operation of the image recording apparatus 10 will be described.

At the time of image recording, the ink Q is circulated by the ink circulation system 16 through the path from the ink supply means 54 through the ink supply flow path 56, the ink flow path 32 of the liquid ejection head 12, and the ink recovery flow path 58 to the ink supply means 54 again. As a result of the circulation, the ink Q flows into the ink flow path 32 at a flow velocity of, for example, 200 mm/second and is supplied to each ejection port 24.

Also, at the time of the image recording, the bias voltage source 52 applies a bias voltage of, for example, 100 V to the ejection electrodes 30. Further, the recording medium P is held by the counter electrode 60 and the counter bias voltage source 62 applies a bias voltage of, for example, −1000 V to the counter electrode 60. Accordingly, between the ejection electrodes 30 and the counter electrode 60 (recording medium P), a bias voltage of 1100 V is applied and electric fields (electrostatic forces) corresponding to the bias voltage are formed.

As a result of the circulation of the ink Q, the electrostatic forces due to the bias voltage, the surface tension of the ink Q, the capillary action, the action of the ink guides 22, and the like, meniscuses of the ink Q are formed at the ejection ports 24. Then, the colorant particles (positively charged in this example) migrate to the ejection ports 24 (meniscuses) and the ink Q is concentrated. As a result of the concentration of the ink Q, the meniscuses further grow. Finally, a balance is obtained between the surface tension of the ink Q and the electrostatic forces or the like, and the meniscuses are placed in a stabilized state.

In this state, when the drive voltage source 50 applies drive voltages of, for example, 200 V to the ejection electrodes 30, the electrostatic forces acting on the ink Q and the meniscuses are increased, and the concentration of the ink Q at the meniscuses is promoted. As a result, the meniscuses rapidly grow. Following this, when the growing force of the meniscuses, the moving force of the colorant particles to the meniscuses, and the attractive force from the counter electrode 60 exceed the surface tension of the ink Q, the ink Q whose colorant particles are concentrated is ejected as the ink droplets R.

The ejected ink droplets R fly due to momentum at the time of the ejection and the attractive force by the counter electrode 60, adheres to the recording medium P, and form an image.

As described above, at the time of the image recording, the recording medium P is conveyed in the scanning direction orthogonal to the nozzle lines to be scanned while facing the liquid ejection head 12.

Accordingly, by performing modulation in accordance with image data (ink droplet R ejection signal) and applying a drive voltage to each ejection electrode 30 (driving the ejection electrode 30) in synchronization with the conveying and scanning of the recording medium P, it becomes possible to perform modulation and eject the ink droplets R in accordance with an image to be recorded and perform image recording onto the entire surface of the recording medium P in an on-demand manner.

As described above, the liquid ejection head 12 according to the present invention is provided with the ink guides 22 whose end portions 44 are molded in a shape similar to the tip end shape, and the ink droplets R are ejected by the ink guides 22.

As described above, in the case of the ink guide 22 of this embodiment, the edge portion **44*b* of the end portion 44 functions as the pinning point F of the meniscus $M_1$ from the ink liquid surface. In addition, the pinning point F also functions as a pinning point that fixes the new meniscus $M_2$. As a result, the meniscus $M_2$ is formed at a higher position. Also, in the tip end portion 42, the meniscus $M_3$ having approximately the same shape as the tip end 46*a* of the tip end portion 42 is formed. In a state where the ink Q has reached the tip end 46*a* of the ink guide 22** in this manner, it becomes possible to eject the ink droplets R.

Also, the meniscus obtained by the ink guide 22 is a meniscus reflecting the tip end shape of the tip end portion and is different from the meniscus obtained by the ink guide disclosed in JP 10-230608 A in which the tip end shape is determined by the ink. Therefore, even when disturbance, such as vibration, is given, the shape of the meniscus obtained by the ink guide 22 of this embodiment will not fluctuate unlike the conventional case, meaning that the superior meniscus shape stability is achieved. Further, the meniscus obtained by the ink guide 22 reflects the tip end shape of the tip end portion 42 of the ink guide 22, so that it becomes possible to set the ink droplets R in a predetermined size corresponding to the tip end shape of the tip end portion 42.

Therefore, in the image recording apparatus 10 including the liquid ejection head 12, the meniscus is held at a high position at each ejection port 24, so the ink Q is sufficiently supplied to the tip end 46*a*. As a result, even when the ink droplets R are ejected in succession at high speed, the ink Q is sufficiently supplied, which makes it possible to enhance the ejection frequency responsivity of the ink droplets R. As a result, it becomes possible to perform the image recording at high speed.

Further, a superior meniscus shape stability is achieved, so it becomes possible to enhance the adhering position accuracy of the ink droplets R to the recording medium P and eject the ink droplets R in a predetermined size while suppressing variations in size. Therefore, it becomes possible to perform high-quality image recording. Still further, when color images are formed, it becomes possible to perform high-quality image recording by suppressing color drift.

In the liquid ejection head 12 of this embodiment, by providing the ink guide 22, it becomes possible to maintain the high position of the meniscus M at the ejection port 24 and it also becomes possible to stabilize the shape of the meniscus. Therefore, it becomes possible to enhance the ejection frequency responsivity of the ink droplets R and the adhering position accuracy of the ink droplets R and it also becomes possible to reduce variations in size of the ink droplet R. As described above, the liquid ejection head 12 of this embodiment has a high performance in ejection of the ink droplets R.

Also, in the liquid ejection head 12 of this embodiment, each ejection port 24 has an elongated cocoon shape that extends in the ink flow direction D, so the ink Q is sufficiently and smoothly supplied to the ejection port 24. As a result, the ejection frequency responsivity of the ink droplets R is further improved and, in addition, occurrence of clogging of the ejection port 24 by the ink Q is prevented.

Further, with the image recording apparatus 10 including the liquid ejection head 12 of this embodiment, it becomes possible to perform high-quality image recording at high speed.

Next, a second embodiment of the present invention will be described. Note that in this embodiment, each construction element that is the same as a construction element of the image recording apparatus of the first embodiment shown in FIGS. 1 to 3C is given the same reference symbol and the detailed description thereof will be omitted.

Figure 4:
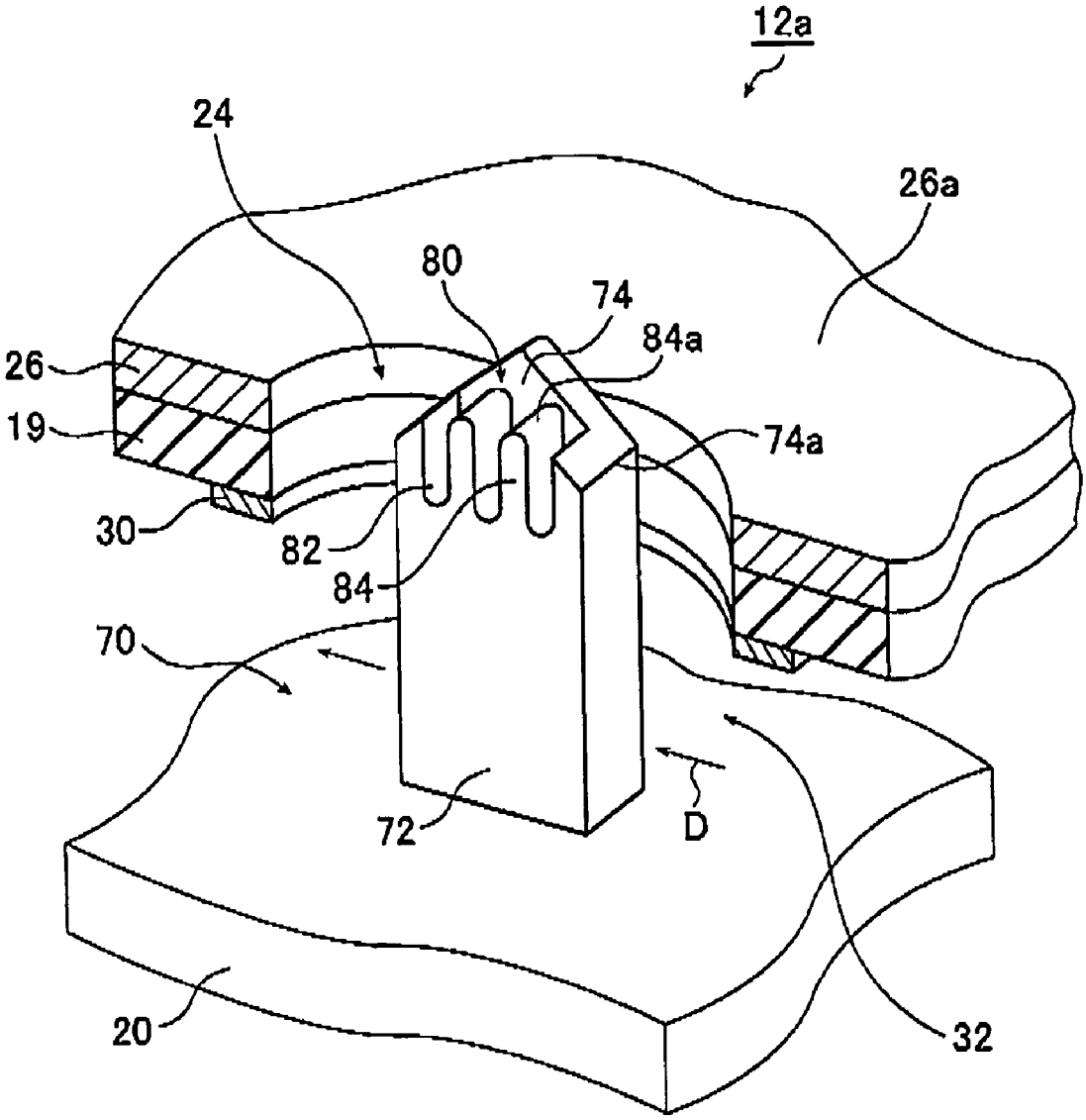
FIG. 4 is a schematic partial cross-sectional view showing a main portion of a liquid ejection head according to a second embodiment of the present invention.
Figure 5A:
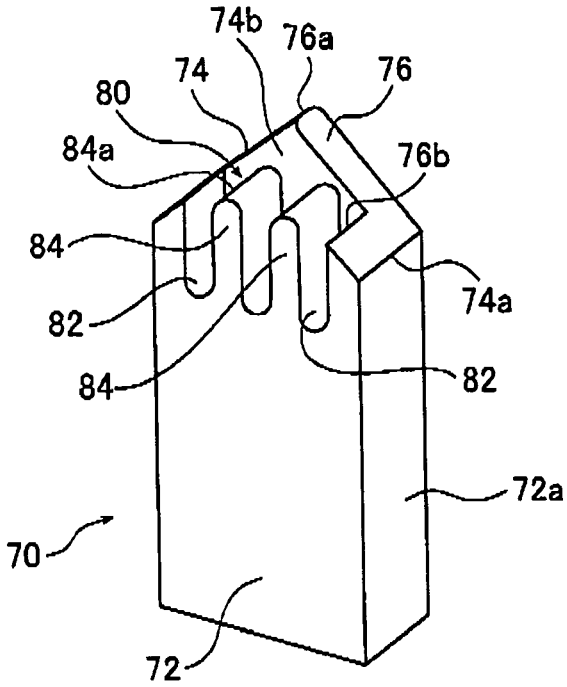
FIG. 5A is a schematic perspective view showing an ink guide of the liquid ejection head according to the second embodiment of the present invention.
Figure 5B:
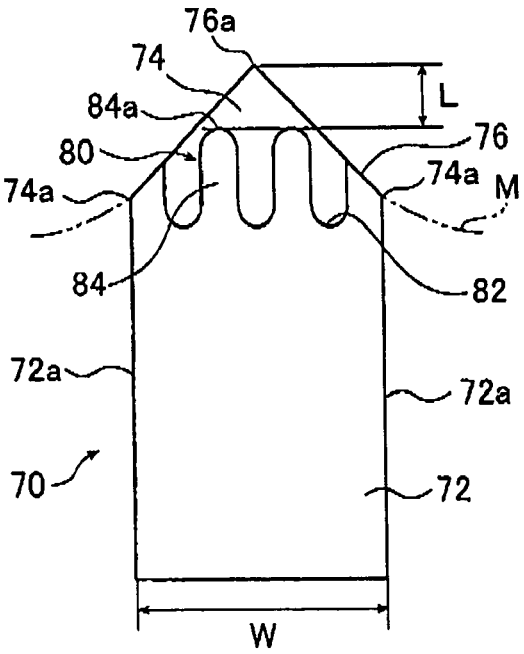
FIG. 5B is a schematic plan view of FIG. 5A.

FIG. 4 is a schematic partial cross-sectional view showing a main portion of a liquid ejection head according to the second embodiment of the present invention. FIG. 5A is a schematic perspective view showing an ink guide of the liquid ejection head according to the second embodiment of the present invention, FIG. 5B is a schematic plan view of FIG. 5A, and FIG. 5C is a schematic side view of FIG. 5A.

A liquid ejection head 12*a* of this embodiment differs from the liquid ejection head 12 of the first embodiment in that an ink guide 70 is used in place of the ink guide 22. Other constructions are the same as those of the liquid ejection head 12 of the first embodiment and the detailed description thereof will be omitted.

Figure 5C:
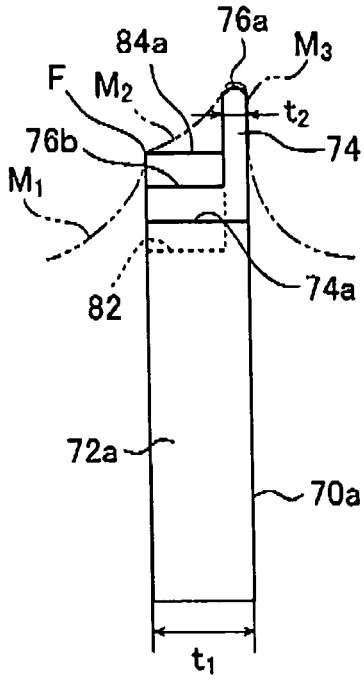
FIG. 5C is a schematic side view of FIG. 5A.

As shown in FIG. 4 to 5C, the ink guide 70 includes a flat-plate-shaped support portion 72 and a tip end portion 74 that extends from the support portion 72 while sharing a back surface 70*a* of the ink guide 70 with the support portion 72. The ink guide 70 differs from the ink guide 22 of the first embodiment in that an end portion 80 of the support portion 72 is molded in a comb shape. Other constructions, such as the tip end shape of the tip end portion 74 and the structure of the support portion 72, are the same as those of the tip end portion 42 and the support portion 40 of the ink guide 22 of the first embodiment and the detailed description thereof will be omitted.

In the end portion 80 of the support portion, one or more (three, in the illustrated example) notched portions 82 extending in a direction in which the tip end portion 74 extends are formed with predetermined intervals therebetween in a widthwise direction of the support portion 72. The three notched portions 82 are formed, so that two tooth portions 84 are formed therebetween. Edge portions 84*a* of the tooth portions 84 on the tip end portion 74 side are each formed by a curved surface having a predetermined curvature. The edge portions 84*a* of the tooth portions 84 exist on the upper side with respect to shoulder portions 76*b* of the tip end portion 76, for instance. By constructing the edge portions 84*a* of the tooth portions 84 with the curved surfaces in this manner, it becomes possible to prevent strong unnecessary electric fields from being generated in proximity to the ejection portions, which makes it possible to stabilize the ink ejection property.

The ink guide 70 of this embodiment is formed to have the comb shaped end portion 80, so that the notched portions 82 play a role of an ink reservoir and a role of capillaries. Accordingly, it becomes possible to supply the ink Q to the tip end portion 74 of the ink guide 70. Therefore, it is preferable that a distance between the edge portions 84*a* of the tooth portions 84 and the tip end 76*a* of the tip end portion 74 be short.

Also, the edge portions 84*a* of the tooth portions 84 function as meniscus pinning points, like the edge portion 44*b* of the ink guide 22 of the first embodiment (see FIG. 3A). Therefore, it is preferable that the edge portions 84*a* of the tooth portions 84 exist on the upper side with respect to the surface of the ejection port 24 (surface 26*a* of the guard electrode 26). In addition, there are many cases where the shoulder portions 76*b* of the tip end portion 76 of the ink guide 70 are arranged on the upper side with respect to the surface of the ejection port 24, so it is preferable that the edge portions 84*a* of the tooth portions 84 exist on the upper side with respect to the shoulder portions 76*b* of the tip end portion 76, for instance.

Further, the end portion 80 of the ink guide 70 is formed in the comb shape, and the tooth portions 84 play a role of a member for reinforcing the tip end portion 74. Therefore, it becomes possible to increase the mechanical strength of the ink guide 70, in particular, the tip end portion 74. The ink guide 70 is an extremely small member and the tip end portion 74 is an extremely thin portion, so it is effective that the mechanical strength of the tip end portion 74 is increased.

Still further, when the edge portions 84*a* of the tooth portions 84 are set on the upper side with respect to the shoulder portions 76*b* of the tip end portion 76, for instance, a distance between the tip end portion 74 and the edge portions 84*a* is shortened and the mechanical strength is increased.

By molding the end portion 80 of the ink guide 70 in the comb shape in the manner described above, it becomes possible to facilitate supply of the ink Q and it also becomes possible to increase the mechanical strength.

It should be noted that the overall height of the ink guide 70 of this embodiment is 580 μm and the overall width W of the ink guide 70 (width of the support portion 72) is 210 μm, for instance. Also, the tip end angle of the tip end portion 74 formed by a pair of inclined surfaces 76 is 90°, the radius of curvature of the tip end portion 74 is 6 μm in either directions of the plan view and the side view, the thickness $t_1$ of the support portion 72 is 50 μm, and the thickness $t_2$ of the tip end portion 74 is 13 μm. Further, a tip end portion length L that is a distance between the edge portions 84*a* of the end portion 80 and the tip end 76*a* of the tip end portion 74 is 50 μm. Still further, the width of the tooth portions 84 is 30 μm and the radius of curvature of the edge portions 84*a* of the tooth portions is 15 μm.

Also, even in the case of the ink guide 70 of this embodiment, like in the first embodiment, it is preferable that a difference between the thickness $t_1$ of the support portion 72 and the thickness $t_2$ of the tip end portion 74 (step between the support portion 72 and the tip end portion 74) be 20 μm or more. Like in the first embodiment, when the ink guide 70 of this embodiment does not have the difference (step) of 20 μm or more, the meniscus pinning effect is reduced.

It should be noted that the ink guide 70 of this embodiment has the construction provided with the three notched portions 82 but the present invention is not limited to this and it is sufficient that at least one notched portion 82 is formed.

Also, it is possible to produce the ink guide 70 of this embodiment with an ink guide manufacturing method that is the same as that for producing the ink guide 22 in the first embodiment.

In the liquid ejection head 12*a* of this embodiment, the ink guide 70 is provided for each ejection port 24 and a meniscus is formed at each ejection port 24. The meniscus formed by the ink guide 70 of this embodiment will be described.

Even in this embodiment, like in the first embodiment, as shown in FIG. 5C, the edge portions 84*a* of the end portion 80 function as pinning points F of a meniscus $M_1$. The pinning points F are determined based on the comb shape of the end portion 80 and are stable points that will not move once fixed. In addition, the pinning point F also functions as a pinning point for fixing a new meniscus $M_2$. Thus, the meniscus $M_2$ is formed at a higher position. As a result, it becomes possible to make the ink Q reach the tip end 76*a* of the tip end portion 74. In addition, a meniscus $M_3$ in approximately the same shape as the tip end 76*a* of the tip end portion 74 is also formed at the tip end portion 74.

The end portion 80 of the ink guide 70 of this embodiment is molded in the comb shape, so the end portion 80 is long as compared with the end portion 44 of the ink guide 22 of the first embodiment. Therefore, it becomes possible to, as compared with the case of the ink guide 22 of the first embodiment, further strongly fix the meniscus and further increase the meniscus shape stability.

Also, in the case of the ink guide 70 of this embodiment, the ink Q is accumulated in the notched portions 82 and is supplied to the tip end portion 74 of the ink guide 70 by capillary action. Therefore, the ink guide 70 has capability of supplying ink higher than that of the ink guide 22 of the first embodiment.

As described above, with the ink guide 70 of this embodiment, it becomes possible to, as compared with the case of the ink guide 22 of the first embodiment, hold the meniscus at a higher position and supply the ink Q to the tip end portion 74 more smoothly.

It should be noted that, needless to say, the liquid ejection head 12*a* and the image recording apparatus including the liquid head 12*a* of this embodiment are capable of providing the same effect as in the first embodiment described above.

With the liquid ejection head 12*a* of this embodiment, it becomes possible to increase the meniscus shape stability and the capability of supplying ink by the ink guide 70 from those of the ink guide 22 of the first embodiment, and eject the ink droplets in a state where the ink Q has reached the tip end 76*a* of the ink guide 70. Also, the meniscus shape stability is further increased, so even when disturbance such as vibration is given, fluctuations of the meniscus shape are further suppressed.

In the liquid ejection head 12*a* of this embodiment, by providing the ink guide 70, it becomes possible to further raise the position of the meniscus at the ejection port 24 and further stabilize the shape of the meniscus M, which makes it possible to further enhance the ejection frequency responsivity of the ink droplets R and the adhering position accuracy of the ink droplets R, eject the ink droplet R in a predetermined size while reducing variations in size of the ink droplets R, and further increase the ink droplet ejection property.

Also, in the image recording apparatus including the liquid ejection head 12*a* of this embodiment, at each ejection port 24, the meniscus is held at a higher position and the ink Q is further sufficiently supplied from the notched portions 82 of the end portion 80 to the tip end 76*a*. Therefore, it becomes possible to further enhance the ejection frequency responsivity. As a result, it becomes possible to perform image recording at higher speed.

Further, in the image recording apparatus including the liquid ejection head 12*a* of this embodiment, a further superior meniscus shape stability is achieved, so it becomes possible to perform higher-quality image recording. Still further, when color images are formed, it becomes possible to perform high-quality image recording by further suppressing color drift.

Next, the ink Q used in the image recording apparatus of the first and the second embodiments will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and preferably equal to or larger than $10^{10}$ Ω·cm). If the electrical resistance of the carrier liquid is low, the concentration of the colorant particles does not occur since the carrier liquid receives the injection of electric charges and is charged due to a drive voltage applied to the ejection electrodes. In addition, since there is also anxiety that the carrier liquid having a low electrical resistance causes the electrical conduction between adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby an electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of ink under a low electric field becomes worse. Also, the reason why the relative permittivity preferably falls within the above-mentioned range is that if the relative permittivity becomes high, then an electric field is relaxed due to the polarization of a solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of the fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of the dispersion resin particles include rosins, rosin-modified phenol resin, alkyd resin, a (meth) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of the colorant particles decreases, the following problems become easy to arise. The density of a printed image is insufficient, the affinity between the ink Q and the surface of the recording medium P becomes difficult to obtain to prevent an image firmly stuck to the surface of the recording medium P from being obtained, and so forth. On the other hand, if the content of the colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined in the formula (2) given below is preferably equal to or larger than 50%, more preferably equal to or larger than 60%, and much more preferably equal to or larger than 70%.

$$P=100\times(\sigma 1-\sigma 2)/\sigma 1 \quad (2)$$

In the above formula (2), σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and an electrode for liquid (LP-05 manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also ink does not leak or spread to the periphery of the head to contaminate the head.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to a dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding a charging control agent thereto.

(2) A method including: adding a colorant and optionally dispersion resin particles and a dispersing agent into a carrier liquid at the same time for dispersion; and adding a charging control agent thereto.

(3) A method including adding a colorant and a charging control agent and optionally a dispersion resin particles and a dispersing agent into a carrier liquid at the same time for dispersion.

Next, the evaluation of the meniscus height and the ink ejection property was done for the cases of the ink guide 22 of the first embodiment shown in FIG. 3A, the ink guide 70 of the second embodiment shown in FIG. 5A, the conventional ink guide 100 shown in FIG. 6A, and the conventional ink guide 204 shown in FIG. 7, As to the meniscus height, whether the ink has reached the tip end of the ink guide was evaluated. Note that the meniscus height evaluation result was set as "A" when the ink has reached the tip end of the ink guide and was set as "B" when the ink did not reach the tip end of the ink guide.

Also, as to the ink ejection property, a dot size, ink adhering position accuracy, responsivity, and the like at the time of ink ejection were comprehensively evaluated. The ink ejection property evaluation result was set as "A" when the ejection property was extremely superior, was set as "B" when the ejection property was superior, and was set as "C" when the ink was not sufficiently ejected or the ink ejection was impossible. These results are shown in Table 1 given below. Note that in Table 1, the ink guide 22 of the first embodiment is denoted as "Example 1", the ink guide 70 of the second embodiment is denoted as "Example 2", the ink guide 100 is denoted as "Comparative Example 1", and the ink guide 204 is denoted as "Comparative Example 2".

It should be noted that in Comparative Example 1 (ink guide 100), the overall height was 580 μm, the overall width was 210 μm, and the thickness was 50 μm.

Also, in Comparative Example 2 (ink guide 204), the overall height was 580 μm, the overall width was 210 μm, and the thickness was 50 μm. In addition, the width of the ink guide groove 220 was 50 μm.

TABLE 1

| | Evaluation item | |
|---|---|---|
| | Meniscus height | Ink ejection property |
| Example 1 | A | B |
| Example 2 | A | A |
| Comparative Example 1 | B | C |
| Comparative Example 2 | A | C |

As shown in Table 1 given above, with each of the ink guide 22 (Example 1) of the first embodiment of the present invention and the ink guide 70 (Example 2) of the second embodiment of the present invention, a meniscus height reaching the tip end was obtained. Also, the ink guide 22 of the first embodiment of the present invention was superior also in ink ejection property and the ink guide 70 of the second embodiment was further superior in ink ejection property.

On the other hand, with the ink guide 100 (Comparative Example 1), a sufficient meniscus height was not obtained and ink ejection was impossible.

Also, with the ink guide 204 (Comparative Example 2), a meniscus height reaching the tip end was obtained and ink ejection was possible. In this case, however, the obtained dot size and ink droplet adhering position accuracy were insufficient.

The liquid ejection head and the image recording apparatus according to the present invention have been described above in detail, but the present invention is not limited to the embodiments described above, and it is of course possible to make various changes and modifications without departing from the gist of the present invention.

What is claimed is:

1. A liquid ejection head for ejecting droplets of solution in which charged particles are dispersed by exerting electrostatic force on the solution, comprising:

an insulating ejection substrate including through holes for ejecting the droplets;

ejection electrodes for exerting the electrostatic force on the solution, which are arranged to respectively correspond to the through holes; and solution guides that respectively pass through the through holes and protrude from the ejection substrate toward a droplet ejection side, wherein each of the solution guides includes a support portion of flat-plate shape and a tip end portion of flat-plate-shape that is extendingly provided to form a step at a predetermined position in a thickness direction in an end portion of the support portion and is thinner than the support portion, and wherein the solution guides are arranged so that the tip end portion is directed toward the droplet ejection side.

2. The liquid ejection head according to claim 1, wherein said tip end portion of each of said solution guides has a tip end shape that is gradually narrowed toward the droplet ejection side, and wherein said end portion of said support portion at the step formed through connection of said tip end portion is formed in approximately the same shape as the tip end shape.

3. The liquid ejection head according to claim 1, wherein said tip end portion of each of said solution guides has a tip end shape that is gradually narrowed toward the droplet ejection side, and wherein said end portion of said support portion at the step formed through connection of said tip end portion is formed in a comb shape to have at least one tooth portion formed by forming at least one notched portion to extend toward the droplet ejection side.

4. The liquid ejection head according to claim 3, wherein said at least one tooth portion of said end portion of said support portion formed in the comb shape protrudes toward the droplet ejection side with respect to said end portion of said support portion.

5. The liquid ejection head according to claim 1, wherein a radius of curvature of a tip end of said tip end portion of each solution guide is 2 μm or more.

6. The liquid ejection head according to claim 1, wherein a difference between a thickness of said support portion of each solution guide and a thickness of said tip end portion thereof is 20 μm or more.

7. The liquid ejection head according to claim 1, wherein said tip end portion is extendingly provided for said support portion so that the step is formed only on one surface side of said tip end portion.

8. An image recording apparatus, including a liquid ejection head for ejecting droplets of solution in which charged particles are dispersed by exerting electrostatic force on the solution, said liquid ejection head comprising:

an insulating ejection substrate including through holes for ejecting the droplets;

ejection electrodes for exerting the electrostatic force on the solution, which are arranged to respectively correspond to the through holes; and solution guides that respectively pass through the through holes and protrude from the ejection substrate toward a droplet ejection side, wherein each of the solution guides includes a support portion of flat-plate shape and a tip end portion of flat-plate shape that is extendingly provided to form a step at a predetermined position in a thickness direction in an end portion of the support portion and is thinner than the support portion, wherein the solution guides are arranged so that the tip end portion is directed toward the droplet ejection side, and wherein an image corresponding to image data is recorded on a recording medium.

9. The image recording apparatus according to claim 8, wherein said tip end portion of each of said solution guides has a tip end shape that is gradually narrowed toward the droplet ejection side, and wherein said end portion of said support portion at the step formed through connection of said tip end portion is formed in approximately the same shape as the tip end shape.

10. The image recording apparatus according to claim 8, wherein said tip end portion of each of said solution guides has a tip end shape that is gradually narrowed toward the droplet ejection side, and wherein said end portion of said support portion at the step formed through connection of said tip end portion is formed in a comb shape to have at least one tooth portion formed by forming at least one notched portion to extend toward the droplet ejection side.

11. The image recording apparatus according to claim 10, wherein said at least one tooth portion of said end portion of said support portion formed in the comb shape protrudes toward the droplet ejection side with respect to said end portion of said support portion.

12. The image recording apparatus according to claim 8, wherein a radius of curvature of a tip end of said tip end portion of each solution guide is 2 μm or more.

13. The image recording apparatus according to claim 8, wherein a difference between a thickness of said support portion of each solution guide and a thickness of said tip end portion thereof is 20 μm or more.

14. The image recording apparatus according to claim 8, wherein said tip end portion is extendingly provided for said support portion so that the step is formed only on one surface side of said tip end portion.

* * * * *